United States Patent [19]

Konishi et al.

[11] 4,379,395

[45] Apr. 12, 1983

[54] INTERSTAND TENSION CONTROL SYSTEM AND METHOD FOR TANDEM ROLLING MILL

[75] Inventors: Seizi Konishi; Kazuyuki Tashiro, both of Kitakyushu; Yoshihiro Kamigane, Hitachi; Takakazu Sakurai, Mito; Shinya Tanifuji; Yasuo Morooka, both of Hitachi, all of Japan

[73] Assignee: Hitachi, Ltd., Tokyo, Japan

[21] Appl. No.: 234,405

[22] Filed: Feb. 13, 1981

[30] Foreign Application Priority Data

Feb. 20, 1980 [JP] Japan ..... 55-19091

[51] Int. Cl.[3] ..... B21B 37/06

[52] U.S. Cl. ..... 72/8; 72/23; 72/203; 364/472

[58] Field of Search ..... 72/8, 14, 23, 25, 203, 72/19; 364/469, 472, 475

[56] References Cited

U.S. PATENT DOCUMENTS

| | | | |
|---|---|---|---|
| 3,807,208 | 4/1974 | Hensleigh | 72/19 |
| 3,940,960 | 3/1976 | Tanifuji et al. | 72/19 |
| 4,137,742 | 2/1979 | Tanifuji et al. | 72/19 |

*Primary Examiner*—Lowell A. Larson
*Assistant Examiner*—Jonathan L. Scherer
*Attorney, Agent, or Firm*—Antonelli, Terry & Wands

[57] ABSTRACT

An improved system and method for controlling the interstand tension in a tandem rolling mill by computing the interstand tension on the basis of detected process data, computing the difference or error between the computed interstand tension and the desired value, and controlling the speed of the rolling stand drive motors so as to cancel the error. A shear is generally disposed upstream of the tandem rolling mill to shear the leading and trailing ends of a workpiece. When the shear is cutting the trailing end of the workpiece, a backward tension is produced between the shear and the first rolling stand of the tandem rolling mill, resulting in abrupt variations of the process data used for the computation of the interstand tension. The system operation will become unstable when such abruptly varying process data are used to compute the interstand tension for the purpose of the motor speed control. To avoid the instability of system operation, the process data detected immediately before the operation of the shear are held in a filter, and the interstand tension is computed on the basis of the process data thus held in the filter. The error between the computed interstand tension and the desired value is computed to provide the interstand tension control signal which is applied to the motor speed control unit.

14 Claims, 11 Drawing Figures

INTERSTAND TENSION CONTROL SYSTEM AND METHOD FOR TANDEM ROLLING MILL

BACKGROUND OF THE INVENTION

1. Field of the Invention

This invention relates to a system and a method for controlling the interstand tension imparted to a workpiece being rolled by rolling stands of a tandem rolling mill.

2. Description of the Prior Art

In a rolling operation on a workpiece, such as steel sheet or plate and shape or section of steel, to be rolled by a tandem rolling mill, it is desirable that the interstand tension imparted to the workpiece being rolled by rolling stands of the tandem rolling mill be maintained at a predetermined constant value. This is especially important for eliminating dimensional errors due to variations in the interstand tension, that is, deviations of the thickness and width of the workpiece from the predetermined values. In a tandem rolling mill designed for producing section or shape steel bar or the like, the above requirement is also important for eliminating dimensional errors and non-uniformity of the section of the products.

Some of the inventors of the present invention have proposed a method and a system for controlling the interstand tension in a tandem rolling mill without the use of a mechanical looper. Such a method and system are disclosed in, for example, U.S. Pat. Nos. 3,940,960 and 4,137,742. In these U.S. patents, the interstand tension is indirectly detected or arithmetically computed on the basis of physical quantities relating to the tension imparted to a workpiece being rolled and is then compared with a reference or desired value, and the rolling speed of the rolls is controlled to cancel the difference or error therebetween, whereby the interstand tension can be controlled to be maintained constant throughout the rolling operation. In other words, the rolling force P and the rolling torque G are detected to indirectly detect the interstand tension so that the interstand tension can be maintained at the desired value throughout the rolling operation.

The method and system disclosed in these U.S. patents are basically satisfactory in that the interstand tension control in a tandem rolling mill can be generally effected with good accuracy.

However, it has been found during practical rolling operation by a tandem rolling mill incorporating the system of the above noted U.S. patents, a problem arises in that the interstand tension control system acts, in response to an excessively large interstand tension variation, indirectly detected by the system in the final stage of rolling operation, on each of individual workpieces to compensate for the tension variation, sometimes resulting in hunting which prevents stability of the control.

SUMMARY OF THE INVENTION

It is an object of the present invention to provide an improved system and an improved method for controlling the interstand tension imparted to a workpiece being rolled by rolling stands of a tandem rolling mill, by which the interstand tension can be controlled to be maintained constant with high accuracy throughout the rolling operation on the workpiece.

Another object of the present invention is to provide a system and a method of the above character which can reliably attain the stable control of the interstand tension.

According to the present invention, a system and a method for controlling the interstand tension in a tandem rolling mill including a plurality of rolling stands are arranged to detect process data during rolling of a workpiece at each of the rolling stands, to filter the detected process data to eliminate components having frequencies exceeding a predetermined frequency value, to compute the interstand tension on the basis of the filtered process data, and to compare the result of computation with a desired value so as to control and maintain the interstand tension at the desired value, while, during operation of a shear disposed upstream of the tandem rolling mill for cutting the trailing end of the workpiece, the interstand tension is computed using the process data detected immediately before the shear is placed in operation.

Other objects, features and advantages of the present invention will become apparent from the following detailed description of preferred embodiments thereof taken in conjunction with the accompanying drawings.

DESCRIPTION OF THE PREFERRED EMBODIMENTS

Figure 1A:
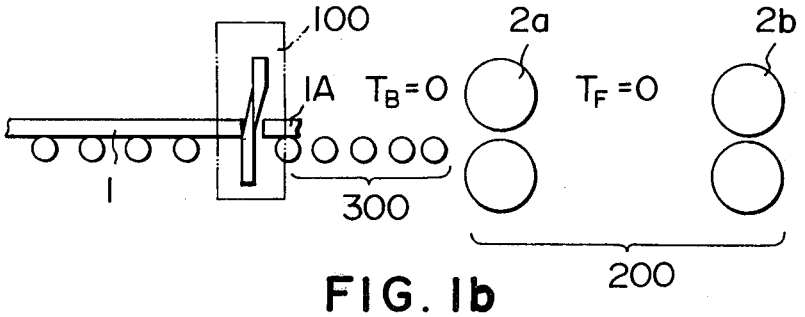
FIGS. 1*a* to 1*d* illustrate rolling conditions of a workpiece rolled by rolling stands of a tandem rolling mill.

The present invention will now be described in detail with reference to the drawings.

Before describing the embodiments of the present invention in detail, the basic concept of the present invention will be described so that it can be more clearly understood. The inventors attempted to apply the aforementioned prior art interstand tension control system to a practical tandem rolling mill. In the practical application of the prior art interstand tension control system to the tandem rolling mill, the inventors found frequent occurrence of an excessively large interstand tension variation in the final stage of rolling operation on a workpiece. Occurrence of such a variation was discovered in the course of reviewing data of many experiments. The results of various researches and studies to find out the cause of occurrence of the excessively large interstand tension variation proved that the timing of occurrence of the interstand tension variation coincided with the operation starting timing of the shear disposed upstream of the tandem rolling mill. This fact has also been confirmed by later experiments. Thus, it has been finally confirmed that the operation of the shear gives rise to the variation in the interstand tension in the final stage of the rolling operation on a workpiece.

The above fact will be qualitatively explained with reference to FIGS. 1*a* to 1*d*. In FIGS. 1*a* to 1*d*, reference numeral 1 designates a workpiece, and reference numerals 2*a* and 2*b* designate work rolls of a first rolling stand, and a second rolling stand respectively, of a tandem rolling mill 200. A shear 100 is disposed upstream of the tandem rolling mill 200. The principal function of this shear 100 is to remove workpiece portions 1A and 1B from the leading and trailing ends, respectively, of the workpiece 1 by shearing. A table roller type conveyor 300 is provided for conveying the workpiece 1 toward the work rolls 2*a* of the first rolling stand.

FIG. 1*a* shows that the portion 1A has been removed from the leading end of the workpiece 1 by the shear 100. At this time, the backward tension $T_B=0$ in the tandem rolling mill 200, and the interstand tension $T_F=0$ naturally.

Figure 1B:
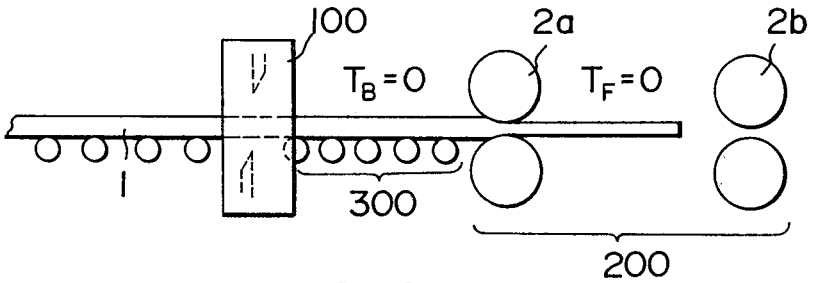

FIG. 1*b* shows that the leading end of the workpiece 100 has passed through the shear 100 and advanced to a position intermediate between the work rolls 2*a* and 2*b* of the first and second rolling stands. At this time too, $T_B=0$ and $T_F=0$.

Figure 1C:
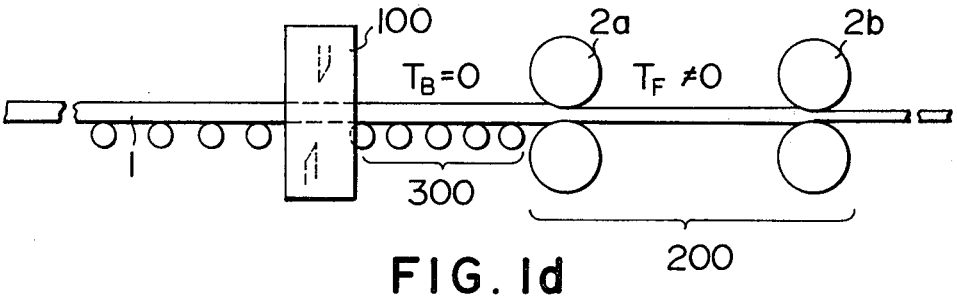

FIG. 1*c* shows that the leading end of the workpiece 100 has passed through the work rolls 2*b* of the second rolling stand of the tandem rolling mill 200, with the workpiece 1 is being rolled in usual manner. At the time, the backward tension $T_B=0$, but the interstand tension $T_F\neq 0$. That is, the interstand tension $T_F$ is so controlled as to be maintained at its desired value $T_{Fo}$ by an interstand tension control system (not shown).

Figure 1D:
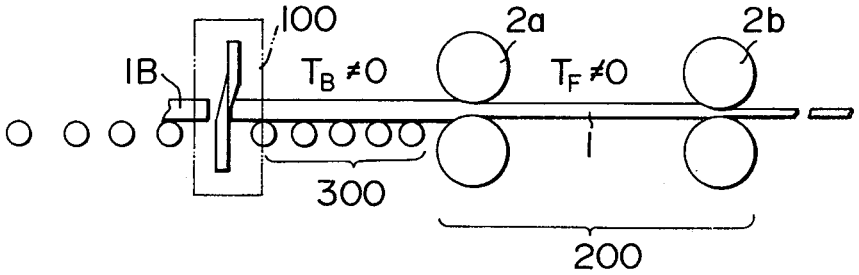

FIG. 1*d* shows that a portion 1B has been removed from the trailing end of the workpiece 1 by the shear 100. The interstand tension $T_F$ has been strictly maintained at its desired value $T_{Fo}$ immediately before the portion 1B is removed from the trailing end of the workpiece 1 by the shear 100. However, a backward tension $T_B$ ($T_B\neq 0$) appears as a result of shearing by the shear 100, and the effect of appearance of the backward tension $T_B$ establishes the relation $T_F\neq T_{Fo}$. The momentary backward tension $T_B$ appearing at the instant of shearing has such a large value that there are great variations in the detected process data such as, for example, data relating to the rolling force and the rolling torque used for arithmetically computing the interstand tension $T_F$. Consequently, by virtue of the variations in the detected process data due to the momentary backward tension $T_B$ the interstand tension $T_F$, arithmetically computed or indirectly detected will also be subject to a great variation.

Such a variation in the interstand tension has been considered to be merely momentary, and the prior art interstand tension control system has tried to faithfully execute its function for the interstand tension control to deal with such a momentary interstand tension variation. Actually, however, the interstand tension control by the interstand tension control system requires the steps of detecting necessary process data, computing the interstand tension on the basis of the detected process data, comparing the result of computation with the desired value to find the difference or error between the former and the latter, computing a speed compensation value required at each rolling stand for cancelling the interstand tension error, adding the speed compensation value to the existing speed command signal, and applying the resultant signal to the motor speed control unit as a new speed command signal. The speed control unit may respond to the speed command signal with a delay and there will also be a response delay due to the inertia of the motors until the motor speed is actually changed according to this new speed command signal. In other words, when the interstand tension control system tries to faithfully execute its interstand tension control function to deal with such a momentary great variation in the interstand tension, the interstand tension control system will not be able to immediately follow the interstand tension variation due to, for example, the response delay of the motor speed control unit, and the delayed control will rather produce an instable state resulting in hunting. Furthermore, due to the fact that the process data themselves, on the basis of which the momentary interstand tension variation is computed, are subject to momentarily abrupt variations, this process data will not be accurate in any way, and the interstand tension computed on the basis of such inaccurate process data will also be probably quite inaccurate in itself. The interstand tension control based upon such an inaccurate interstand tension will necessarily fail to achieve satisfactory accuracy in control, and the multiplied effect of the inaccurate interstand tension control and the response delay of the interstand tension control system will lead inevitably to an instable operation of the overall control system. Although it is commonly known that operational instability of a control system can be eliminated by reducing the gain of the control system, such a reduction in the gain does not in any way improve the accuracy of interstand tension control.

Therefore, the present invention contemplates to obviate various practical problems as pointed out above and to provide an improved interstand tension control system and method which can stably control the interstand tension with high accuracy.

Figure 2A:
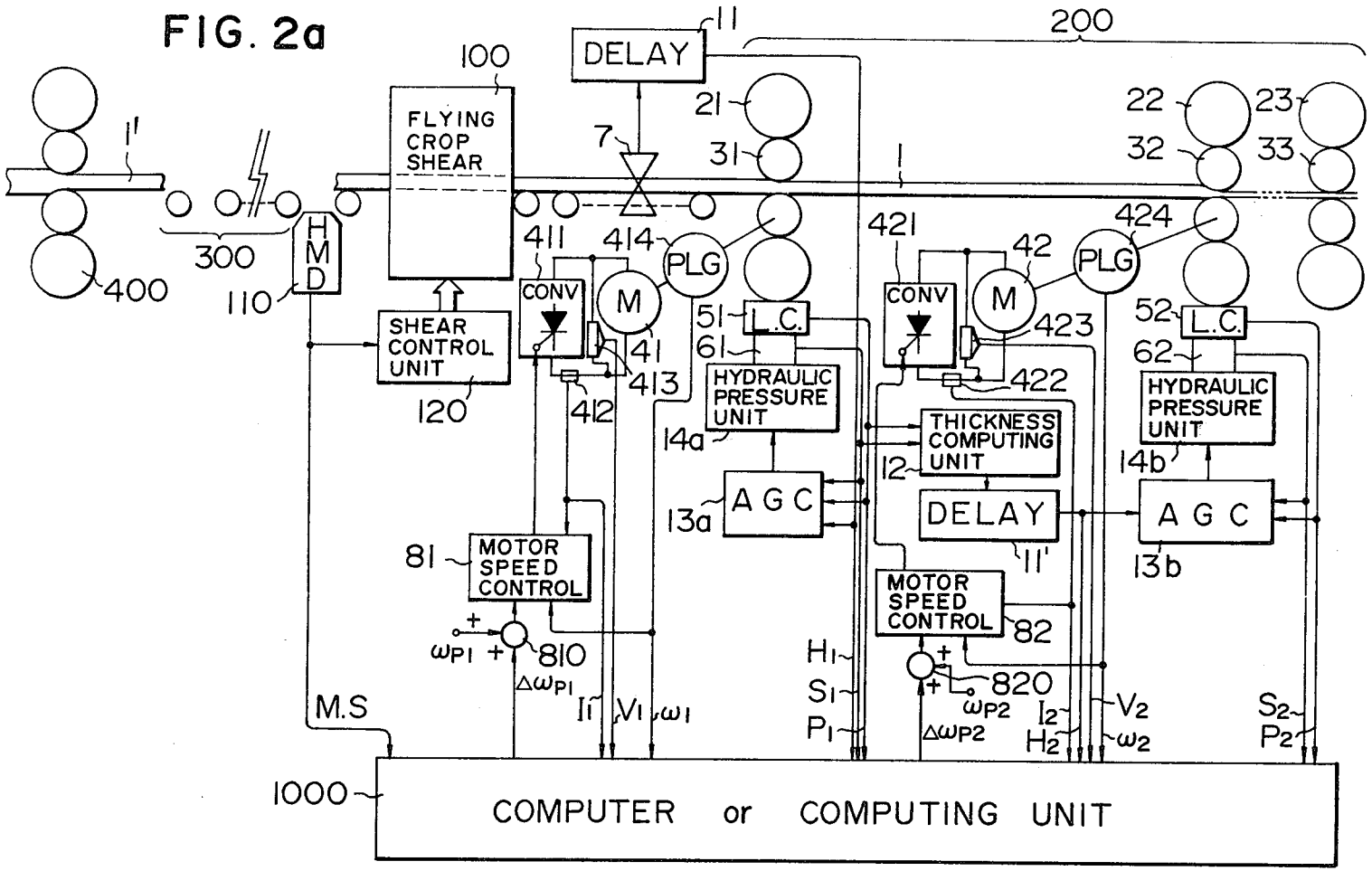
FIG. 2*a* is a schematic diagram showing the structure of an embodiment of the interstand tension control system according to the present invention.

Preferred embodiments of the present invention will now be described in detail and referring first to FIG. 2*a*, reference numerals 1 and 1' designate workpieces, with the reference numeral 200 designating a generally a tandem rolling mill which is, in this case, a hot-finishing rolling mill. The tandem rolling mill 200 is shown to include three rolling stands arranged in tandem, although such a rolling mill is generally composed of four to six rolling stands. Reference numeral 100 designates a shear which may be a flying crop shear well known in the art. Reference numeral 400 designates the last rolling stand of a rough rolling mill. A workpiece, having been rolled by the rough rolling mill, passes through the last rolling stand 400 of the rough rolling mill and is then conveyed by a table roller type conveyor 300 to the hot-finishing rolling mill 200 to be rolled therein. A metal detector 110, which is a hot metal detector (HMD), detects an arrival of the leading end and trailing end of the workpiece at its disposed position. A shear control unit 120 actuates the shear 100 in response to the metal detection signal applied from the HMD 110. Work rolls 31, 32 and 33 of the first, second and third rolling stands are backed up by backup rolls 21, 22 and 23, respectively. Drive motors 41 and 42 drive the work rolls 31 and 32 of the first and second rolling stands respectively. Rolling force detectors 51 and 52, such as load cells (L.C.), detect the rolling forces at the first and second rolling stands, respectively and roll gap detectors 61 and 62 detect the roll gaps of the first and second rolling stands, respectively. Power converters 411 and 421 each including a thyristor, convert AC power into DC power to supply the DC power to the drive motors 41 and 42 respectively. Current detectors 412, 422, voltage detectors 413, 423 and motor speed detectors 414, 424 are associated with the first and second rolling stands respectively. A workpiece thickness detector 7 of, for example, the X-ray type, detects the workpiece thickness at the inlet of the first rolling stand. A delay unit 11 acts to delay the output signal of the workpiece thickness detector 7 by the length of time required for the workpiece to travel the distance between the the detector 7 and the first rolling stand. A workpiece thickness computing unit 12 computes the workpiece thickness $h_1$ at the outlet of the first rolling stand. Another delay unit 11' acts to delay the output signal of the computing unit 12, indicative of the workpiece thickness $h_1$, by the length of time required for the workpiece to travel between the first and second rolling stands thereby generating an output signal indicative of the workpiece thickness $H_2$ at the inlet of the second rolling stand.

Reference numerals 13*a* and 13*b* designate workpiece thickness control units (AGC) associated with the first and second rolling stands, respectively. Reference numerals 14*a* and 14*b* designate hydraulic pressure units imparting the rolling forces to the rolls in the first and second rolling stands, respectively. The units including the drive motor and hydraulic pressure unit associated with the third rolling stand will not be described herein to avoid complexity of explanation. Motor speed control units 81 and 82 control the speeds of the respective motors 41 and 42 in response to speed command signals $\omega_{p1}$ and $\omega_{p2}$ applied from a speed command circuit (not shown). Adders 810 and 820 add $\Delta\omega_{p1}$ and $\Delta\omega_{p2}$ to the speed command signals $\omega_{p1}$ and $\omega_{p2}$, respectively, so as to maintain the interstand tension at the desired value, where $\Delta\omega_{p1}$ and $\Delta\omega_{p2}$ represent speed compensation signals required for controlling the interstand tension to conform to the desired value. The manner of computation of $\Delta\omega_{p1}$ and $\Delta\omega_{p2}$ will be described later. A computing unit 1000 computes the interstand tension in response to the application of necessary process data thereto and generates the signals $\Delta\omega_{p1}$ and $\Delta\omega_{p2}$ so as to maintain the interstand tension at the desired value when the value of the interstand tension obtained by computation does not coincide with the desired value. This computing unit 1000 has a structure as shown in FIG. 2*b*, and part or entirety of its arithmetic units may be provided by a digital computer having necessary control programs stored in its memory.

Figure 2B:
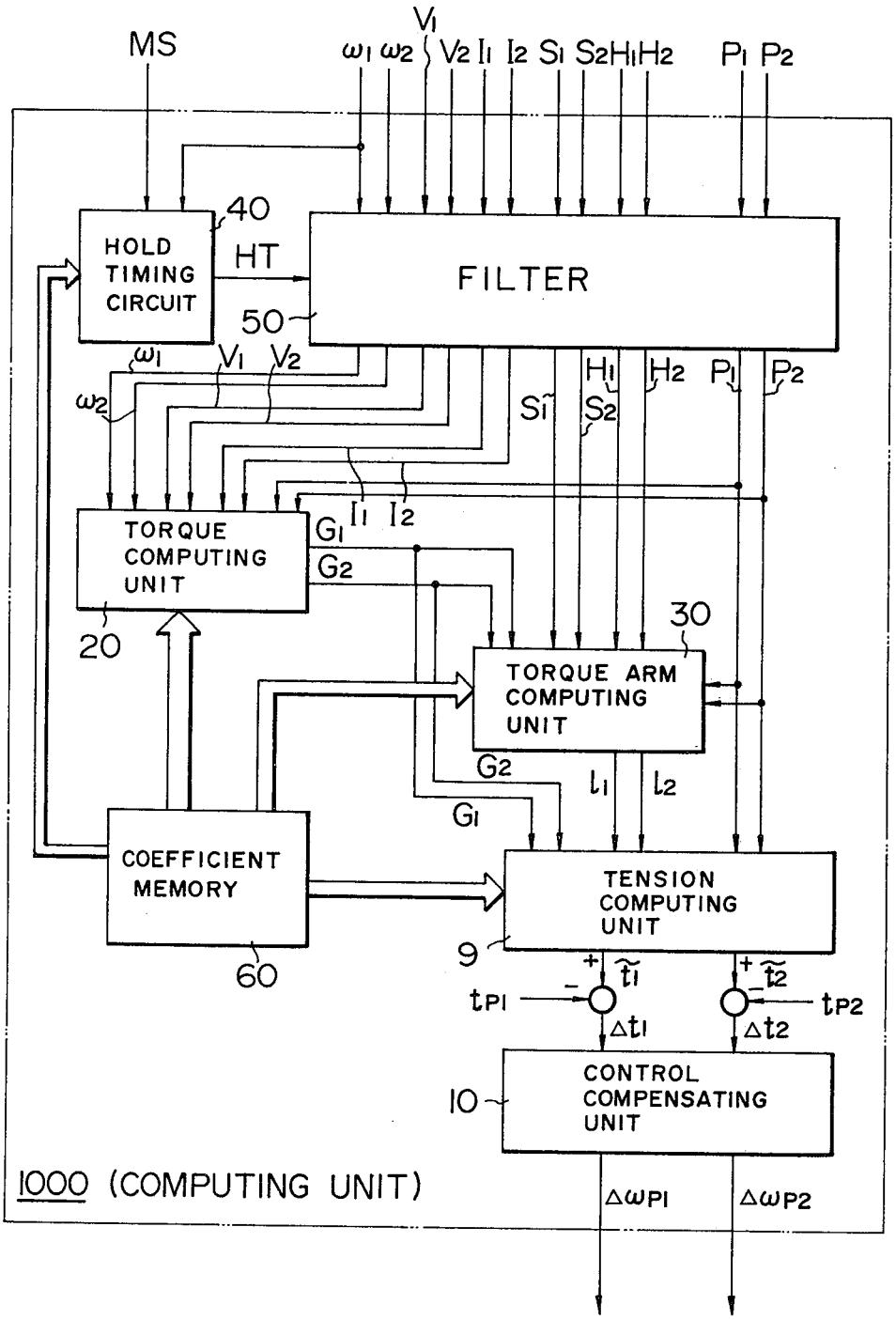
FIG. 2*b* is a block diagram showing the general structure of a computing unit for the control system of FIG. 2*a*.

Referring then to FIG. 2*b* showing the structure of the computing unit 1000, according to this figure, a hold timing circuit 40 generates a hold timing signal HT so that, until the shear 100 completes shearing of the trailing end of the workpiece after it has started its shearing operation, the process data applied to the computing unit 1000 for the computation of the interstand tension can be held at the values applied immediately before the shear 100 is actuated. The process data required for the computation of the interstand tension are applied to a filter 50 which removes higher frequency components of the process data having frequencies exceeding a frequency of, for example 3 to 5 Hz, to which the system is normally responsive. In response to the application of the hold timing signal HT from the hold timing circuit 40, the filter 50 generates the process data applied immediately before the actuation of the shear 100 and held therein during the operating period of the shear 100. The detailed structure of the hold timing circuit 40 and filter 50 will be described later.

A torque computing unit 20 computes the rolling torque $G_i$ required for the computation of the interstand tension and generates an output signal indicative of $G_i$, where the suffix i indicates that the specific rolling torque is that of an i-th rolling stand. Although this rolling torque $G_i$ may be directly detected without resorting to computation, it is obtained by computation in the embodiment of the present invention. A torque arm computing unit 30 computes the torque arm $l_i$ required for the computation of the interstand tension and generates an output signal indicative of $l_i$. An interstand tension computing unit 9 computes the interstand tension $t_i$ in response to the application of the signals indicative of the rolling torque $G_i$, torque arm $l_i$ and rolling force $P_i$. In the embodiment of the present invention, the interstand tension per unit sectional area, that is, the unit interstand tension is computed by the interstand tension computing unit 9. A control compensating unit 10 makes necessary computation to generate a speed compensation signal $\Delta\omega_{pi}$ so as to cancel the deviation of the computed interstand tension $\tilde{t}_i$ from the desired value $t_{oi}$. The interstand tension is controlled by applying the output signal $\Delta\omega_{pi}$ of the control compensating unit 10 to the motor speed control units 81 and 82. The principle of computation of the interstand tension, and also, the manner of regulation of the motor speed using the computed interstand tension for the purpose of maintaining interstand tension at the desired value are disclosed per se in U.S. Pat. No. 4,137,742 and U.S. Pat. No. 3,940,960 referred to hereinbefore. Therefore, any detailed description of such modes is unnecessary. A coefficient memory 60 shown in FIG. 2*b* is provided for storing data such as various coefficients other than the process data required for computation in the various computing units.

The individual computing units 20, 30, 9 and 10 shown in FIG. 2*b* make necessary computations according to the basic equations described below.

(a) Torque computing unit 20

This unit computes the rolling torque $G_i$ according to, for example, the following equation using input data:

$G_i$=(motor torque)−(acceleration-deceleration torque)−(loss torque)

$$= \frac{I_i \cdot (V_i - I_i \cdot r_i - V_B)}{\omega_i} - J_i \frac{d\omega_i}{d\tau} - G_{LOSS}(\omega_i, P_i) \quad (1)$$

where:

$r_i$: main circuit resistance;

$V_B$: brush voltage drop (a constant determined depending on motor);

$J_i$: moment of inertia of energy transmission shaft between motor and work roll;

$$\frac{d\omega_i}{d\tau}:$$

differential of motor speed relative to time; and $G_{LOSS}(\omega_i, P_i)$: loss torque of motor rotation (This is a function of the motor angular velocity $\omega_i$ and rolling force $P_i$.)

(b) Torque arm computing unit 30

This unit computes the torque arm $l_i$ according to the following equation:

$$l_i = l_{io} + \Delta l_i \tag{2}$$

where:

$l_{io}$: reference torque arm (This value is computed according to the following equations (3) and (4) before the workpiece is fed into the nip between the rolls of the (i+1)th rolling stand after having been fed into the nip between the rolls of the i-th rolling stand.); and $\Delta l_i$: torque arm variation after computation of reference torque arm $l_{io}$ (This value can be computed using at least one of the incoming workpiece thickness variation $\Delta H_i$, rolling force variation $\Delta P_i$ and roll gap variation $\Delta S_i$.)

$$2l_{1o} = \frac{G_{1B}}{P_{1B}} \tag{3}$$

$$2l_{io} = \frac{G_{iB}}{P_{iB}} - \frac{R_i}{P_{iB}}\left\{\sum_{j=1}^{i-1} \frac{2l_{jB}\cdot P_{jB} - G_{jB}}{R_j}\right\} \tag{4}$$

The suffix B is added to indicate that each of the values is measured at the timing of computing the associated reference torque arm. Therefore, the individual values are as follows:

$G_{iB}$: rolling torque at timing of computing reference torque arm for i-th rolling stand;

$P_{iB}$: rolling force at timing of computing reference torque arm for i-th rolling stand;

$R_i$: roll radius of i-th rolling stand;

$l_{jB}$: torque arm for j-th rolling stand at timing of computing reference torque arm for i-th rolling stand;

$P_{jB}$: rolling force at j-th rolling stand at timing of computing reference torque arm for i-th rolling stand;

$G_{jB}$: rolling torque at j-th rolling stand at timing of computing reference torque arm for i-th rolling stand $$\Delta l_i = \frac{\partial l}{\partial H}\cdot\Delta H_i + \frac{\partial l}{\partial P}\cdot\Delta P_i + \frac{\partial l}{\partial S}\cdot\Delta S_i \tag{5}$$

where $(\partial l/\partial H)$, $(\partial l/\partial P)$, $(\partial l/\partial S)$: partial differential coefficients for H, P and S, respectively;

$\Delta H_i$, $\Delta P_i$, $\Delta S_i$: variations of $H_i$, $P_i$ and $S_i$ when incoming workpiece thickness $H_{iB}$, rolling torque $P_{iB}$ and roll gap $S_{iB}$ at timing of computing reference torque arm for i-th rolling stand are taken as references.

(c) Interstand tension computing unit 9

This unit computes the unit interstand tension $\tilde{t}_i$ using the rolling torque $G_i$, rolling force $P_i$ and torque arm $l_i$.

The unit interstand tension $\tilde{t}_i$ is first computed from the total interstand tension $T_i$ according to the following equation:

$$\tilde{t}_i = T_i/(h_i \cdot b_i) = T_i/M \tag{6}$$

where:

$h_i$: workpiece thickness at outlet of i-th rolling stand;

$b_i$: workpiece width at outlet of i-th rolling stand; and

M: workpiece sectional area at outlet of i-th rolling stand Then, the total interstand tension between, for example, the first and second rolling stands is computed according to the following equation:

$$T_1 = \frac{2(l_1 - l_2) - \left(\frac{G_1}{P_1} - \frac{G_2}{P_2}\right)}{\frac{R_1}{P_1} + \frac{R_2}{P_2}} \tag{7}$$

(d) Control compensating unit 10

In response to the application of the signal indicative of the interstand tension error $\Delta t_i$, this unit computes the speed compensating signal value $\Delta\omega_{pi}$ which is applied to cancel the error. The error $\Delta t_i$ is expressed as follows:

$$\Delta t_i = \tilde{t}_i - t_{pi} \tag{8}$$

where:

$t_{pi}$: desired interstand tension. Then, $\Delta t_i$ is multiplied by the gain required for stabilizing the interstand tension control, as follows:

$$d_i = K_P\cdot\Delta t_i + \frac{K_P}{T_I}\int \Delta t_i \cdot d\tau \tag{9}$$

where:

$K_P$: proportional gain; and $T_I$: integration time constant.

Subsequently, the value of $d_i$ thus computed is converted into the motor speed unit, as follows:

$$\Delta\tilde{\omega}_{pi} = g_i^{-1} d_i \tag{10}$$

where:

$\Delta\tilde{\omega}_{pi}$: speed compensating signal value converted into motor speed unit; and $g_i^{-1}$: conversion gain The value of the interstand tension $t_i$ approaches the value of $t_{pi}$ when the value of $\omega_{pi}$ obtained by the equation (10) is used for changing or correcting the motor speed. However, since the motor speed at the i-th rolling stand is changed independently of the interstand tension control at the (i−1)th rolling stand disposed upstream of the i-th rolling stand, the interstand tension $t_{i-1}$ between the (i−1)th rolling stand and the i-th rolling stand is thereby adversely affected. To avoid such an adverse effect, the motor speed at the rolling stand or stands disposed upstream of the i-th rolling stand must also be controlled at the same rate at the time of the motor speed control at the i-th rolling stand. The following determinant equation provides the motor speed compensating signal values $\Delta\omega_{pi}$ at the individual rolling stands when the above condition is taken into account.

$$\begin{pmatrix} \frac{\Delta\omega_{p1}}{\omega_1} \\ \frac{\Delta\omega_{p2}}{\omega_2} \\ \vdots \\ \frac{\Delta\omega_{pn}}{\omega_n} \end{pmatrix} = \begin{pmatrix} 1 & 1 & \cdots & 1 \\ 0 & 1 & \cdots & 1 \\ \vdots & & \ddots & \vdots \\ 0 & \cdots & 0 & 1 \end{pmatrix} \cdot \begin{pmatrix} \frac{\Delta\tilde{\omega}_{p1}}{\omega_1} \\ \frac{\Delta\omega_{p2}}{\omega_2} \\ \vdots \\ \frac{\Delta\tilde{\omega}_{pn}}{\omega_n} \end{pmatrix} \tag{11}$$

The structure and function of the hold timing circuit 40 and filter 50 shown in FIG. 2*b* will now be described in detail.

Figure 3A:
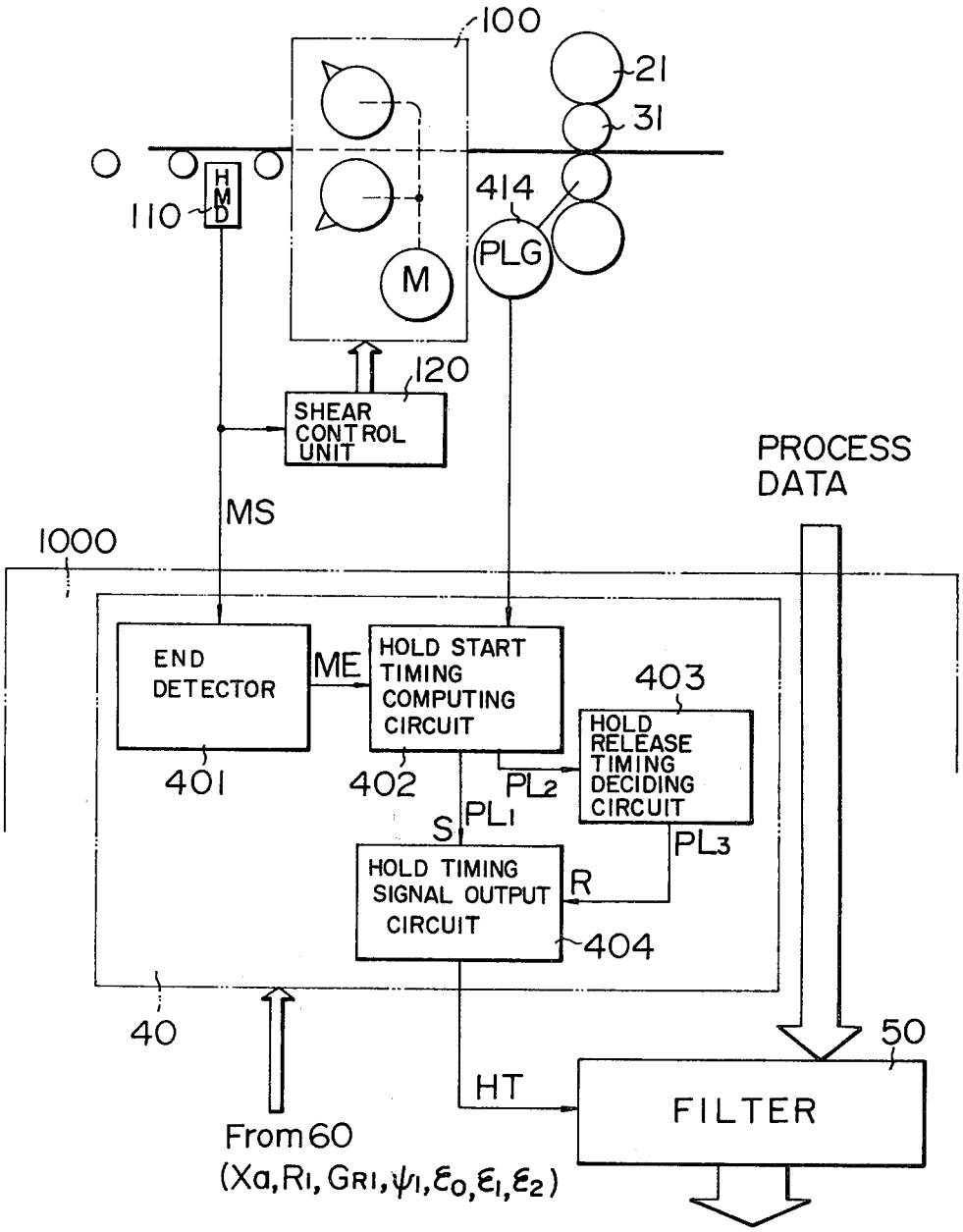
FIG. 3*a* is a block diagram showing in detail the structure of the hold timing circuit in the computing unit shown in FIG. 2*b*.
Figure 3B:
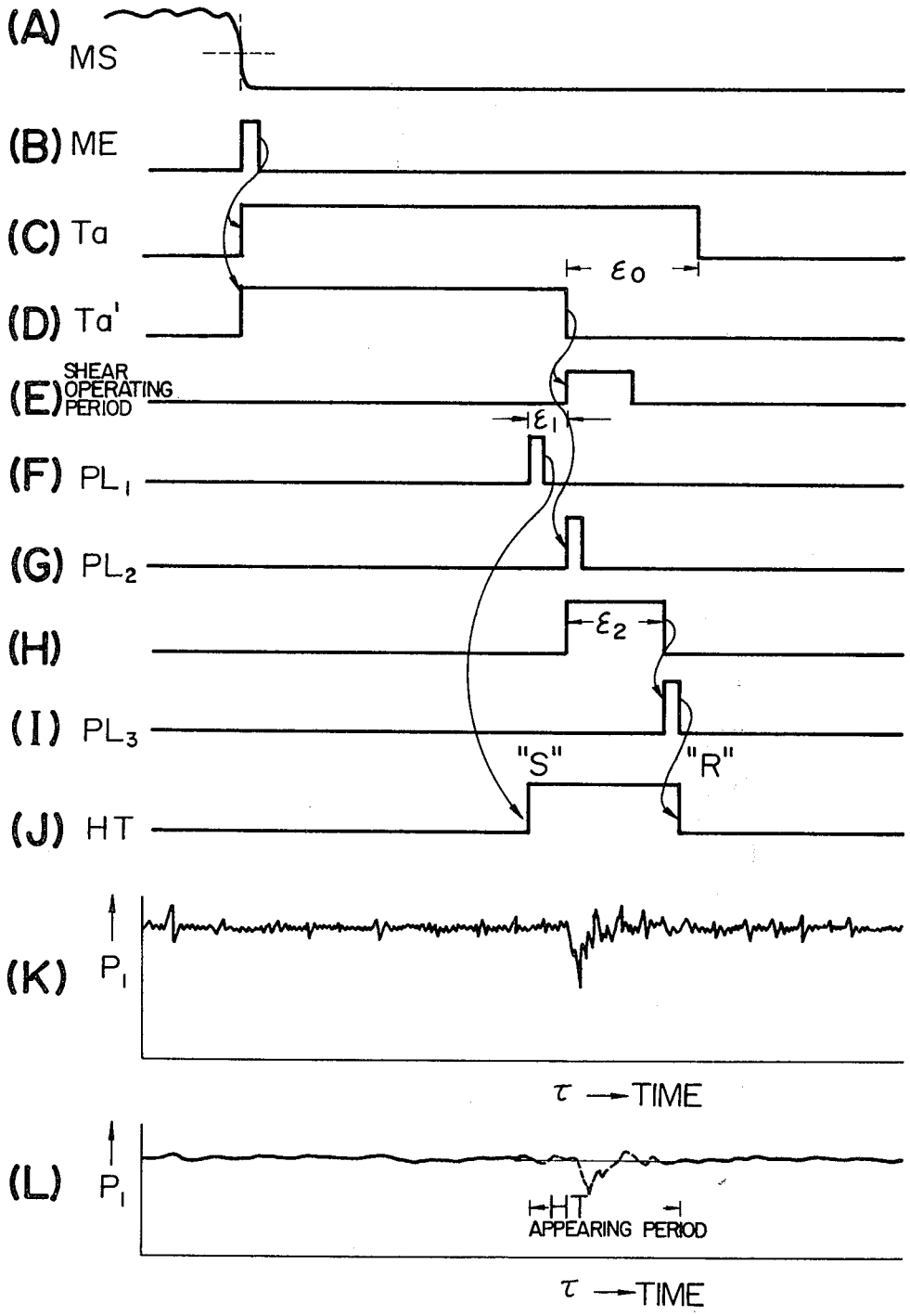
FIG. 3*b* is a time chart showing signal waveforms for illustrating the operation of the hold timing circuit shown in FIG. 3*a*.

Referring to the hold timing of circuit 40 in FIG. 3, the output signal MS from the HMD 110 is applied to an end detector 401 which detects the trailing end of the workpiece. A hold start timing computing circuit 402 determines the hold start timing on the basis of the detected workpiece conveying speed in response to the application of the output signal ME from the end detector 401. A hold release timing deciding circuit 403 decides the timing of releasing the hold timing signal HT. A hold timing signal output circuit 404 generates the hold timing signal HT until it is reset by the output signal $PL_3$ from the hold release timing deciding circuit 403 after it has been set by the output signal $PL_1$ from the hold start timing computing circuit 402. Actually, this output circuit 404 may be in the form of a flip-flop (F.F.). When now the end detector 401 detects arrival of the trailing end of the workpiece by an abrupt change in the level of the signal MS as shown in (A) of FIG. 3*b*, its output signal ME having a waveform as shown in (B) of FIG. 3*b* is applied to the hold start timing computing circuit 402, and a hold start timing pulse $PL_1$ as shown in (F) of FIG. 3*b* appears from the circuit 402 as a result of computation described below.

In the first step, the circuit 402 computes the average time Ta required for the trailing end of the workpiece to travel from the disposed position of the HMD 110 to the disposed position of the shear 100. This average time Ta has a length as shown in (C) of FIG. 3*b* and is computed according to the following equation:

$$Ta = \frac{Xa}{\omega_1 \cdot R_1 \cdot \frac{1}{GR_1} \cdot (1 + \psi_1)} \tag{12}$$

where

Xa: distance between disposed position of HMD 110 and that of shear 100 (constant)

$\omega_i$: rotation speed of motor at first rolling stand (variable)

$R_1$: roll radius at first rolling stand (constant)

$GR_1$: gear ratio (constant)

$\Psi_1$: backward slip rate defined by a ratio of the working piece feeding speed to the peripheral speed of the working roll. (constant)

The circuit 402 then computes the shear actuation start timing Ta' as shown in (D) of FIG. 3*b* according to the following equation using the value of Ta thus computed:

$$Ta' = Ta - \epsilon_0 \tag{13}$$

where $\epsilon_0$ is the sum of the time required for the workpiece to travel by a distance corresponding to the length of the workpiece portion cut away from the trailing end and a delay time between the start in drive of the shear and the beginning of its cutting operation.

The hold start timing pulse $PL_1$ appears from the timing computing circuit 402 at time earlier by $\epsilon_1$ than the fall time of the waveform Ta' shown in (D) of FIG. 3*b*, that is, at time earlier by $\epsilon_1$ than the shearing start timing of the shear 100. The value of $\epsilon_1$ may be theoretically "0" but is desirable for the value to be 20 ms to 1 sec for leaving a margin. Another timing pulse $PL_2$ as shown in (G) of FIG. 3*b* appears from the timing computing circuit 402 at the shearing start timing of the shear 100 which operates for a period of time as shown in (E) of FIG. 3*b*.

The hold timing signal output circuit 404 is set by the pulse $PL_1$ and starts to generate a hold timing signal HT as shown in (J) of FIG. 3*b*.

In response to the application of the timing pulse $PL_2$ shown in (G) of FIG. 3*b*, the hold release timing deciding circuit 403 generates a hold release timing pulse $PL_3$ as shown in (I) of FIG. 3*b*. It will be seen in (G), (H) and (I) of FIG. 3*b* that this timing pulse $PL_3$ is obtained by delaying the timing pulse $PL_2$ by a predetermined period of time $\epsilon_2$. The period of $\epsilon_2$ shown in (H) of FIG. 3*b* is slightly longer, for example, by 0.1 sec than the time period for cutting operation of the shear 100 shown in (E) of FIG. 3*b*.

The hold timing signal output circuit 404 is reset by the hold release timing pulse $PL_3$ applied from the circuit 403 and ceases to generate the hold timing signal HT as shown in (J) of FIG. 3*b*.

It will thus be seen that the hold timing circuit 40 detects arrival of the trailing end of the workpiece at a predetermined position, and, on the basis of the end detection signal MS and the detected workpiece conveying speed, generates a hold timing signal HT, as shown in (J) of FIG. 3*b*, which covers the operating period of the shear 100. Therefore, when the output data are held in the filter 50 in response to the appearance of this signal HT, the process data are not used for the computation of the interstand tension during the operating period of the shear 100. Such a data output inhibit mode is shown in (K) and (L) of FIG. 3*b*. FIG. 3*b* shows in (K) that $P_1$, which is one of the process data, is continuously detected by the load cell 51 and applied to the filter 50 to appear as an output as shown by $P_1$ in (L) of FIG. 3*b*. It will be seen in (L) of FIG. 3*b* that $P_1$ is maintained constant during the appearing period of the hold timing signal HT. The broken curve portion shown in the waveform of $P_1$ during the appearing period of the signal HT represents the variation of $P_1$ when this data is not held in the filter 50 by the action of the data hold timing circuit 40.

Figure 4:
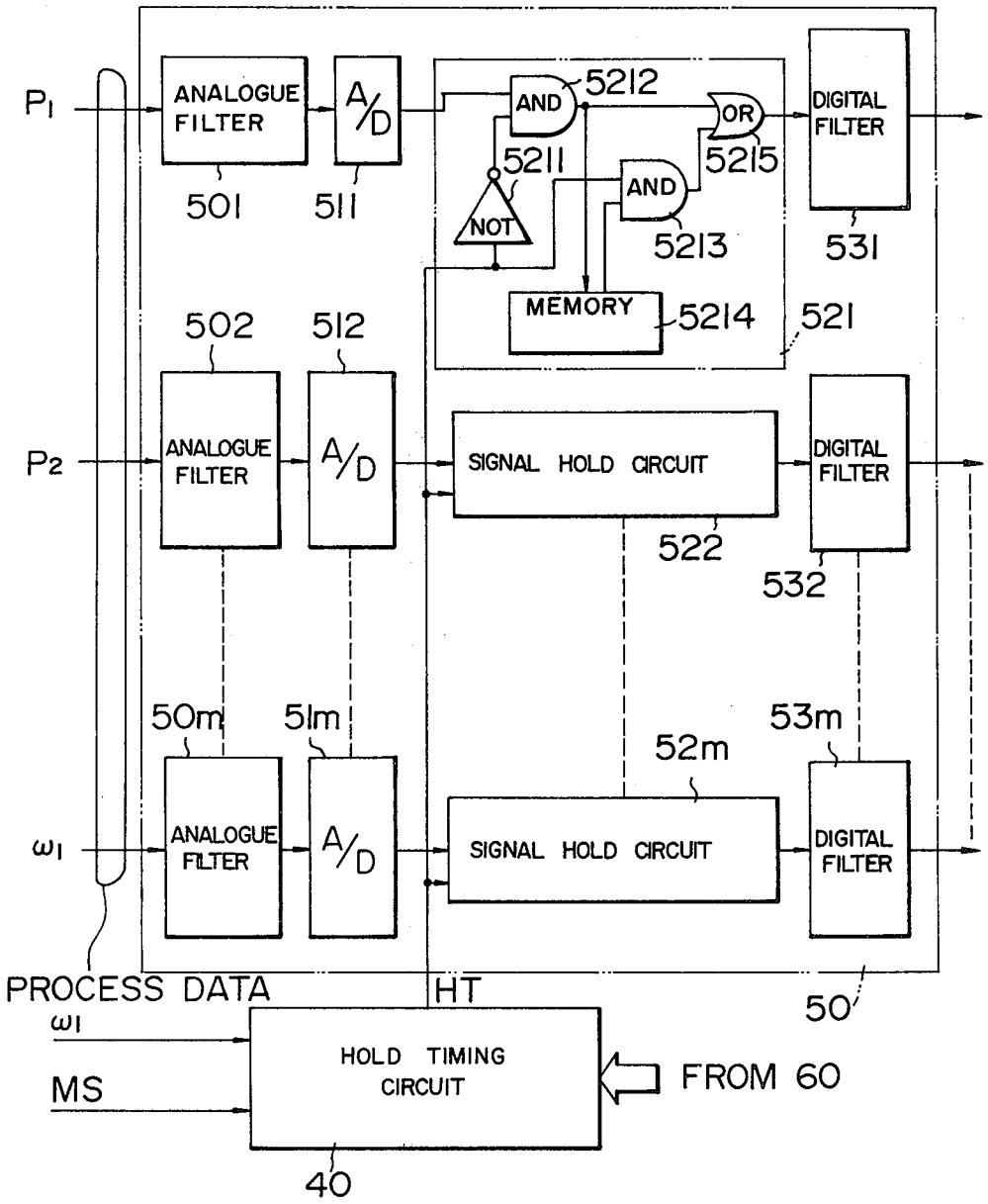
FIG. 4 is a block diagram showing in detail the structure of the filter in the computing unit shown in FIG. 2*b*.
Figure 5A:
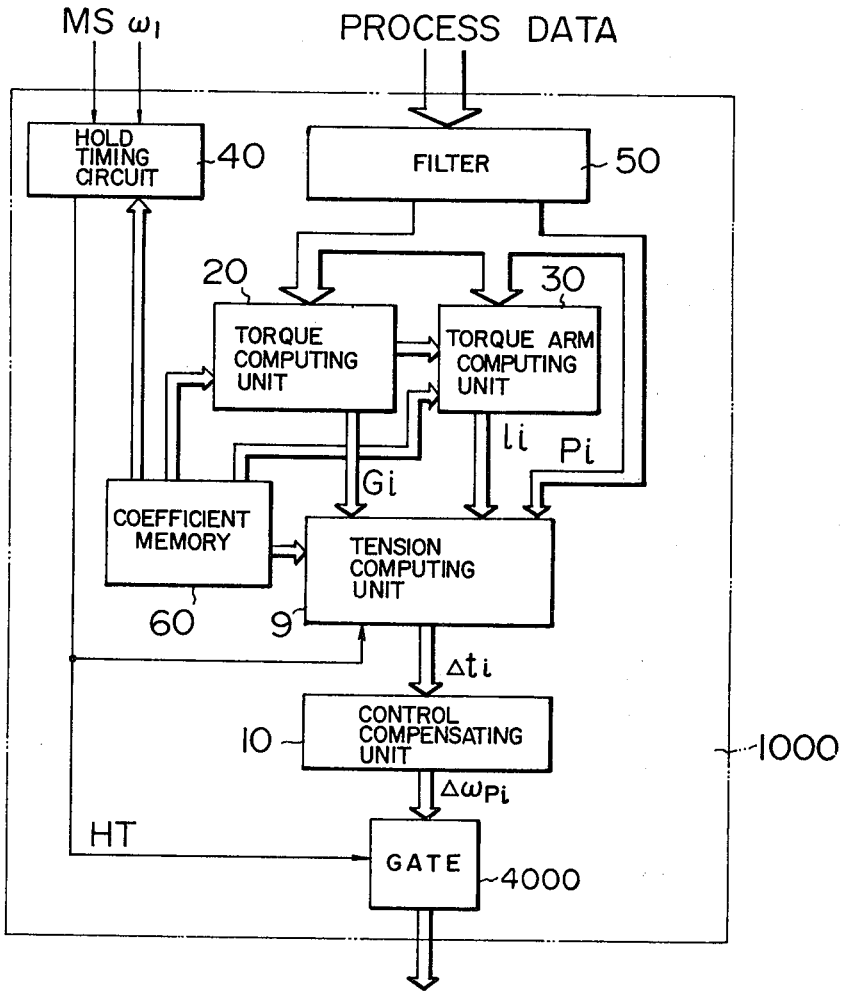
FIG. 5*a* is a block diagram of another form of the computing unit shown in FIG. 2*b*.
Figure 5B:
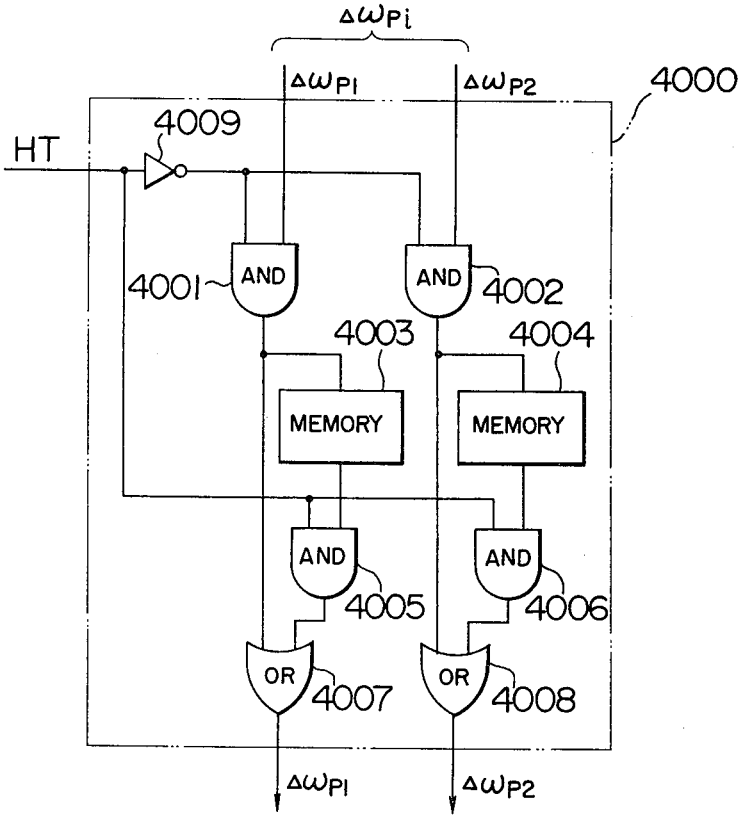
FIG. 5*b* is a block diagram showing in detail the structure of the gate circuit in the computing unit shown in FIG. 5*a*.

Referring to FIG. 4, the filter 50 includes a plurality of analogue filters 501, 502,–, 50*m* to which the process data $P_1$, $P_2$,–, $\omega_1$ are applied respectively and a plurality of analog-digital (A/D) converters 511, 512,–, 51*m* connected to the analogue filters 501, 502,–, 50*m* respectively. Signal hold circuits 521, 522,–, 52*m* connected to the A/D converters 511, 512,–, 51*m* hold the process data $P_1$, $P_2$,–, $\omega_1$, respectively, during the period of time in which the hold timing signal HT appears from the hold timing circuit 40. Digital filters 531, 532,–, 53*m* are connected to the signal hold circuits 521, 522,–, 52*m* respectively.

Each of the signal hold circuits 521, 522,–, 52*m* includes a memory and simple logic circuits. As an example, the practical structure of the signal hold circuit 521 is shown in FIG. 4. The block 521 includes a NOT circuit 5211, AND circuits 5212, 5213, a memory 5214 and an OR circuit 5215 as shown. In the absence of the hold timing signal HT, the AND condition for the AND circuit 5212 holds, and the output $P_1$ of the A/D converter 511 is applied to the digital filter 531. At this time, the data $P_1$ is also stored in the memory 5214. The content of this memory 5214 is renewed each time the output of the A/D converter 511 is applied thereto. On the other hand, in the presence of the hold timing signal HT, the AND condition for the AND circuit 5213 holds now, and the data $P_1$ applied immediately before the appearance of the hold timing signal HT and stored in the memory 5214 is now applied to the digital filter 531. Upon subsequent disappearance of the hold timing signal HT, the AND condition for the AND circuit 5212 holds again, and the output $P_1$ of the A/D converter 511 is applied to the digital filter 531.

As described hereinbefore, the hold timing circuit 40 shown in FIG. *2b* generates the hold timing signal HT during the period of time in which the probability of process data variations is highest due to the operation of the shear 100, and this hold timing signal HT is applied to the filter 50 so that any process data that may be applied during this period of time may not appear as its outputs, and instead, those applied immediately before the appearance of the hold timing signal HT appear as the outputs of the filter 50. Therefore, the computing units 20, 30, 9 and 10 execute computations on the basis of the latter data during the appearing period of the hold timing signal HT. Thus, the interstand tension is controlled, as a matter of fact, on the basis of the process data including the rolling torque, rolling force and torque arm detected immediately before the appearance of the hold timing signal HT. Therefore, the system shown in FIG. *2b* or FIG. *2a* can operate stabily without being adversely affected by possible excessive variations of the process data attributable to the operation of the shear 100.

The present invention is in no way limited to the specific embodiment shown in FIGS. *2a* and *2b*, since it is only required that the system can operate stabily without being adversely affected by process data variations attributable to the operation of the shear 100, as a matter of fact.

Thus, the present invention includes all of arrangements in which the actuation of the shear 100 is detected by some means, and the interstand tension control using the process data that may be applied during the operating period of the shear 100 is inhibited during at least that period of time.

For example, the computing unit 1000 may have a modified structure as shown in FIG. *5a* in which the same reference numerals are used to designate the same parts appearing in FIG. *2b*. That is, during the time period when the hold timing signal HT is present, each of the units is rendered to temporarily stop its computing operation and simultaneously the speed compensation output obtained from the results of computation based on the process data detected immediately before the appearance of the hold timing signal HT is maintained during that time period. This is achieved by the circuit of FIG. *5a* in which 4000 is a gate circuit incorporated with a memory circuit and arranged to hold the output of the unit 10 produced immediately before the appearance of the hold timing signal HT during the time period when the signal HT is present. The gate 4000 may be arranged as shown in FIG. *5b* in which 4001 and 4002 are AND gates, 4009 is a NOT circuit, 4003 and 4004 are memory circuits, 4005 and 4006 are AND gates, and 4007 and 4008 are OR circuits.

The hold timing circuit 40 may be any one of means which can provide an output signal corresponding to or covering the operating period of the shear 100 and is thus is no way limited to the structure shown in FIG. *3a*. For example, the drive signal driving the shear drive motor may be utilized as the hold timing signal HT, or the output of the load cell which is a high-response detector may be utilized as the hold timing signal when it exceeds greatly the predetermined change. It is apparent that such signals may be suitably combined to provide the hold timing signal HT.

It will be appreciated from the foregoing detailed description that the present invention provides an improved interstand tension control system and method which can stably control the interstand tension in a tandem rolling mill.

What is claimed is:

1. An interstand tension control system for a tandem rolling mill including a plurality of rolling stands and a shear means disposed upstream of the tandem rolling mill, for cutting the leading and trailing ends of a workpiece, said system comprising means for detecting process data required for a computation of interstand tension imparted to a workpiece being rolled by the tandem rolling mill, computing means for computing the interstand tension on the basis of the outputs from said process data detecting means thereby generating an interstand tension control signal for cancelling a deviation of the computed interstand tension from a desired value, interstand tension regulating means for regulating the interstand tension at the desired value on the basis of the interstand tension control signal generated from said computing means, means for producing a hold timing signal covering the operating period of said shear means by estimating or directly detecting an operating period of said shear, and means for inhibiting the interstand tension control on the basis of said detected process data during the operating period of said shear.

2. An interstand tension control system as claimed in claim 1, wherein said computing means comprises said hold timing signal producing means and said interstand tension control inhibiting means.

3. An interstand tension control system as claimed in claim 1 wherein said hold timing signal producing means produces said hold timing signal in response to an application of a metal detection signal from a metal detector disposed upstream of said shear means and a signal indicative of a conveying speed of the workpiece.

4. An interstand tension control system as claimed in claim 1, wherein said hold timing signal producing means produces said hold timing signal in response to an application of a metal detection signal from a metal detector disposed upstream of said shear means, a signal indicative of the workpiece conveying speed, and a signal indicative of a rolling force detected at a first rolling stand of said tendem rolling mill.

5. An interstand tension control system as claimed in one of claims 1, 2, 3, 4 or 11, wherein said interstand tension control inhibiting means comprises filter means for removing noise components included in said detected process data, said filter means including means for providing the process data detected immediately before the appearance of said hold timing signal to be used for computing the interstand tension when said hold timing signal appears.

6. An interstand tension control system as claimed in one of claims 1, 2, 3, 4 or 11, wherein said interstand tension control inhibiting means comprises gate means for inhibiting application of said interstand tension control signal to said interstand tension regulating means during the appearing period of said hold timing signal.

7. An interstand tension control system as claimed in claim 1, 2, 3, 4, or 11, wherein said interstand tension control signal is a speed compensating signal for compensating for errors in driving speed of motors driving the work rolls in said tendem rolling mill.

8. An interstand tension control method in a tandem rolling mill, the rolling mill including a plurality of rolling stands, a shear means, disposed upstream of the tandem rolling mill, for cutting leading and trailing ends of a workpiece to be rolled and a detector means for detecting process data to be used for computing an interstand tension imparted to the workpiece being rolled by the tandem rolling mill, the interstand tension control method comprising the steps of producing a hold timing signal covering an operating period of said shear means, and controlling the interstand tension upon an occurrence of said hold timing signal, in dependence upon an interstand tension control signal which has been utilized immediately before the occurrence of said hold timing signal.

9. An interstand tension control method as claimed in claim 8, wherein the interstand control signal is obtained by a computation on the basis of the process data detected by the detector means immediately before the occurrence of said hold timing signal.

10. An interstand tension control method as claimed in claim 8, wherein the tandem rolling mill further includes an interstand tension regulating means, and wherein the method further comprising the steps of using said hold timing signal for suppressing application of an interstand tension control signal to the interstand tension regulating means so that the interstand tension control on the basis of said detected process data can be inhibited during the operating period of said shear means.

11. An interstand tension control system as claimed in claim 2, wherein said hold timing signal producing means produces said hold timing signal in response to an application of a metal detection signal from a metal detector disposed upstream of said shear means, a signal indicative of the workpiece conveying speed, and a signal indicative of a rolling force detected at a first rolling stand of said tandem rolling mill.

12. An interstand tension control system as claimed in claim 5, wherein said interstand tension control signal is a speed compensating signal for compensating for errors in driving speed of motors driving the work rolls in said tandem rolling mill.

13. An interstand tension control system as claimed in claim 2, wherein said hold timing signal producing means produces said hold timing signal in response to an application of a metal detection signal from a metal detector disposed upstream of said shear means and a signal indicative of a conveying speed of the workpiece.

14. An interstand tension control system as claimed in claim 6, wherein said interstand tension control signal is a speed compensating signal for compensating for errors in driving speeds of motors driving the work rolls in said tandem rolling mill.

* * * * *